US008579777B2

(12) United States Patent
Hatano et al.

(10) Patent No.: US 8,579,777 B2
(45) Date of Patent: Nov. 12, 2013

(54) METHOD AND DEVICE FOR PRODUCING BOX OF CORRUGATED BOARD SHEET

(75) Inventors: Osamu Hatano, Hiroshima (JP); Kazuya Sugimoto, Hiroshima (JP); Mitsuhiro Nadachi, Hiroshima (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 104 days.

(21) Appl. No.: 12/740,176

(22) PCT Filed: Jun. 23, 2009

(86) PCT No.: PCT/JP2009/061799

§ 371 (c)(1),
(2), (4) Date: Jun. 8, 2010

(87) PCT Pub. No.: WO2010/001838

PCT Pub. Date: Jan. 7, 2010

(65) Prior Publication Data

US 2011/0092351 A1 Apr. 21, 2011

(30) Foreign Application Priority Data

Jul. 1, 2008 (JP) ..... 2008-172429

(51) Int. Cl.
*B31B 1/14* (2006.01)

(52) U.S. Cl.
USPC ..... 493/56; 493/179; 493/182; 493/362

(58) Field of Classification Search
CPC ..... B31B 1/14; B31B 1/16; B31B 1/20
USPC ..... 493/52, 56, 64, 361, 362, 370, 59, 60, 493/69–72, 160, 178–182
IPC ..... B31B 1/14, 1/16, 1/20
See application file for complete search history.

(56) References Cited

U.S. PATENT DOCUMENTS 1,258,294 A * 3/1918 Wright et al. ..... 493/56
1,832,481 A * 11/1931 Gebhart ..... 493/60

(Continued)

FOREIGN PATENT DOCUMENTS

JP 02089629 A * 3/1990 ..... 493/180
JP 07-052282 A 2/1995

(Continued)

OTHER PUBLICATIONS

JPO machine translation of JP 07-52282 A, retrieved Mar. 7, 2013, 4 pages.*
JPO machine translation of JP 08-91679 A, retrieved Mar. 7, 2013, 7 pages.*

(Continued)

*Primary Examiner* — Stephen F Gerrity
(74) *Attorney, Agent, or Firm* — Kanesaka Berner & Partners, LLP

(57) ABSTRACT

Disclosed is a method for producing a board box by performing a box-making process of a corrugated board sheet which is formed to have dimensions of a plurality of board boxes wherein the yield of the board sheet and the production efficiency are enhanced and a countermeasure can be taken against paper powder. A method for making a box of a corrugated board sheet by performing a box-making process of a board sheet (S) which is formed to have dimensions of a plurality of board boxes and the cutting the board sheet (S) into dimensions of one board box comprises a step (I) for cutting the board sheet (S) into dimensions of one board box by a cut line (k) in the direction intersecting the conveyance direction (a) along a box making line (PL) after a ruling and grooving step (C) and before a pasting and folding step (E), and a speed increase step (J) for spacing the board sheets ($S_1$) and ($S_2$) thus cut by a set dimension following to the cutting step (I) by increasing the speed of the board sheets ($S_1$) and ($S_2$) while conveying toward a subsequent step.

6 Claims, 6 Drawing Sheets

(56) References Cited

U.S. PATENT DOCUMENTS

| | | | | | |
|---|---|---|---|---|---|
| 2,982,189 | A | * | 5/1961 | Shields | 493/30 |
| 3,307,995 | A | * | 3/1967 | Martin, Sr. | 156/216 |
| 3,308,723 | A | * | 3/1967 | Bergh, Jr. | 493/354 |
| 3,913,464 | A | * | 10/1975 | Flaum | 493/142 |
| 4,759,741 | A | * | 7/1988 | Chisholm, Jr. | 493/181 |
| 5,181,899 | A | * | 1/1993 | Hill et al. | 493/34 |
| 5,375,492 | A | | 12/1994 | Smitterberg et al. | |
| 5,624,369 | A | * | 4/1997 | Bidlack et al. | 493/355 |
| 5,964,686 | A | * | 10/1999 | Bidlack et al. | 493/59 |

FOREIGN PATENT DOCUMENTS

| | | | |
|---|---|---|---|
| JP | 8-500297 | A | 1/1996 |
| JP | 8091679 | A | 4/1996 |
| JP | 2002067190 | A | 3/2002 |
| JP | 2008093997 | A | 4/2008 |
| WO | 2010-001838 | A1 | 2/2010 |

OTHER PUBLICATIONS

JPO machine translation of JP 2002-67190 A, retrieved Mar. 7, 2013, 13 pages.*

JPO machine translation of JP 2008-93997 A, retrieved Mar. 7, 2013, 19 pages.*

USPTO Official Translation of JP 02-89629, document No. PTO 13-2753, Mar. 2013, 12 pages.*

ISR for PCT/JP2009/061799 dated Sep. 29, 2009, 2 pages.

International Preliminary Report on Patentability for PCT/JP2009/061799, issued Feb. 8, 2011, 6 pages.

Republic of Korea Patent Office Action mailed Aug. 31, 2012, in Patent Application No. 10-2010-7011704, with English translation, 6 pages.

Japanese Office Action for Application No. 2008-182429 mailed Oct. 9, 2012, 6 pages.

JP Decision to Grant in corresponding Japanese Patent Application No. 2008-12429, 4 pages.

* cited by examiner

METHOD AND DEVICE FOR PRODUCING BOX OF CORRUGATED BOARD SHEET

RELATED APPLICATIONS

The present application is national phase of International Application No. PCT/JP2009/061799, filed Jun. 23, 2009, and claims priority from, Japanese Application Number 2008-172429, filed Jul. 1, 2008, the disclosures of which are hereby incorporated by reference herein in their entirety.

BACKGROUND OF THE INVENTION

1. Technical Field

In a device for producing a box of a corrugated board sheet, the present invention relates to a method and device for producing a box of a corrugated board sheet in which box-producing precision and processing efficiency are enhanced by performing a box-producing process of a board sheet which is formed with a size of a plurality of corrugated board boxes and cutting the board sheet into a plurality of pieces each having a size of one corrugated board box.

2. Description of the Related Art/Background Art

A corrugated board sheet manufactured by a corrugator is processed for printing, creasing and slotting on a conveyance line of the box-producing machine, and then formed into a square tube in a gluing step and a folding step in which a gluing margin of one side panel of four panel box is overlapped and glued to another side panel to form a body in a shape of a square tube, and flaps extending from each panel form a bottom part and a top part of the box.

FIG. 5 illustrates a general structure of a box-producing line of the corrugated board box. In FIG. 5, the box-producing line starts from the right side and the corrugated board sheet S is conveyed in a direction of arrow a so as to conduct the box-producing process. In the upstream of the box-producing process, front and back linerboards and a corrugated board sheet S of a corrugating medium to be interposed between the linerboards, are produced and stacked in a paper supply part A. In this, the corrugated board sheet S is trimmed in the corrugator line and short ends and long ends are cut into a predetermined size and also the creasing in a longitudinal direction (crease lines b) is done.

In the paper supply part A, the corrugated board sheets S are positioned in the same direction and stacked so as to form a group $G_1$ of the corrugated board boxes. The corrugated board sheet S of the bottom of the supply part is fed individually from the supply part A to a flexo-printing machine B in which four colors in total (at least two ink colors) are printed on the corrugated board sheet S one color at a time, and the printed corrugated board sheet S is transferred to a slotter•creaser C which performs the creasing and slotting steps in a plurality of places on the corrugated board sheet in a traveling direction (four places in FIG. 5) so as to form crease lines c and slots d parallel to the short end of the sheet S and a gluing margin f.

Subsequently, a hole-making step is performed in a die-cut unit D, and in a folding unit D, the gluing margin f is applied glue and folded so as to attach the gluing margin f to the side e joined/attached to the side e, thereby producing a square-tube shaped corrugated board box W. Next, the corrugated board box W in a flat state is transferred to a counter ejector F in which the number of sheets is counted and stacked in the same direction so as to make a group $G_2$ of the corrugated board boxes. Finally, the corrugated board box group $G_2$ is transferred to a binding machine located on a downstream side of the transferring direction by a transferring conveyor so as to bundle the corrugated board boxes ready for shipment.

Conventionally, when producing a board box of a smaller size, a box-producing machine specialized for small boxes is needed as the size of the board sheet is smaller. But the need for producing small board boxes is not very high and the installation cost becomes expensive to install the small-box producing machine and it is inadvisable. Thus, a method is adopted, in which a corrugated board sheet having a size of two board boxes is produced and then the board sheet is cut into two pieces each having a size of one board box.

Patent Document 1 (JP8-500297T published in 1996) discloses a structure of a device of slitting a corrugated paperboard box in which one board box having a size of two boxes is produced and stacked and then cut symmetrically in half crosswise.

Moreover, Patent Document 2 (JP2002-67190A) discloses a structure of a slotter for grooving a corrugated board sheet formed with a size of two board boxes.

These types of box-producing methods have advantages that the production speed is doubled and the production efficiency is enhanced. There is another advantage that small boxes can be made by using the regular box-producing machine, which broadens the objects that the regular box-producing machine can process.

However, in the box-producing method disclosed in Patent Document 1, folding precision of the corrugated board sheet by the folding unit E is important. That is, if the folding of the corrugated board sheet is not performed precisely by the folding unit E, the panels are not folded at a right angle and the flaps that close the top and bottom of the corrugated box become misaligned, which is called fish tail. When the two-box connected corrugated board sheet is cut into two boxes in this state at the cutting line in the center, one board box has misaligned flaps in one direction and the other board box has misaligned flaps in an opposite direction and neither of the produced boxes is qualified as a product.

Therefore, in the box producing process of two-box connected board sheet, it is necessary to produce a corrugated board box while the occurrence of the fish tail is minimized and the precision of box producing is enhanced. Further, according to the cutting method of the Patent Document 1, the cutting position is easily misaligned as a stack of the board boxes each having a size of two boxes is cut all at once. If the stack of the board boxes is not symmetrically cut in half, the neither one of the cut boxes meets the standard size, thereby being disqualified as a product.

Furthermore, when cutting the two-box connected board boxes, paper powder is generated at the section being cut. This can deteriorate the surrounding environment and the paper powder can get in the corrugated board box group G2 having been cut and stacked, thereby reducing the quality of the corrugated board box.

RELATED PATENT DOCUMENT

Patent Document

[Patent Document 1] JP8-500297T
[Patent Document 2] JP2002-67190A

SUMMARY OF THE INVENTION

In a view of the problems of the prior art, an object of the present invention is to provide a method and a device for producing a corrugated board box by performing a box-making process of a corrugated board sheet which is formed with a size of a plurality of boxes wherein the effects on the folding precision in the folding unit is reduced, the size of the corrugated board box having been cut is precisely maintained, the yield of the cardboard sheet is enhanced and a countermeasure can be taken against paper powder.

To achieve the above object, the present invention provides a method of producing a box of a corrugated board sheet by preprocessing a corrugated board sheet having a size of a plurality of corrugated board boxes and then cutting the corrugated board box into a plurality of pieces each having a size of one corrugated board box, the method having the steps of: creasing the corrugated board sheet; slitting the corrugated board sheet; gluing the corrugated board sheet; folding the corrugated board sheet; after the creasing and slitting steps and before the gluing and folding steps, cutting the corrugated board sheet into a plurality of pieces each having a size of one corrugated board box along a cutting line intersecting a conveyance direction that is in parallel with a production line of the corrugated board box; and after the step of cutting the corrugated board sheet, transferring the plurality of pieces each having the size of one corrugated board box at an increased speed toward a subsequent step so as to space the plurality of pieces by a set distance.

According to the method of the present invention, the cutting step for cutting the corrugated board sheet having a size of a plurality of boxes into pieces each having a size of one box is performed after the creasing and slitting steps and before the gluing and folding steps. At the location, the corrugated board sheets are transferred one by one and thus, it is easy to cut each corrugated board sheet having a size of a plurality of boxes. Therefore, compared to the method of cutting the stack of corrugated board boxes at a time as in Patent Document 1, the cutting precision of the corrugated board sheet is further enhanced.

Further, as the gluing and folding steps are performed after the cutting step, even if there is a small corrugated board sheet having a poor folding precision in the folding unit, this affects only one small corrugated board sheet.

In the conventional folding step, the corrugated board sheets before being cut into smaller pieces were spaced, which inevitably required a longer traveling distance and thus it was difficult to space each corrugated board sheet during the transferring.

In contrast, according to the method of the present invention, the speed increasing step is provided so as to space the corrugate board sheets after the corrugated board sheet is cut into pieces each having a size of one box, thereby ensuring the space between the corrugated board sheets. This diminishes the occurrence of defects in the folding step and makes the counting of the corrugated board boxes easier by the counter executer.

Furthermore, the corrugated board sheet having a size of a plurality of boxes is cut into pieces each having a size of one box before the gluing and folding steps so as to shorten the span of the corrugated board sheet to less than half. Thus, handling of the corrugated board sheet before the gluing and folding steps becomes easier and the folding precision is enhanced. Therefore, the small corrugated board sheet can be folded with high precision while being transferred at a high speed, thereby improving the production efficiency and the yield of the corrugated board sheet and diminishing the defects.

Moreover, by using a corrugated board sheet of a large dimension having a size of a plurality of boxes and cutting the large corrugated board sheet into smaller pieces so as to produce smaller size boxes, the production efficiency is doubled at the same conveying speed.

It is also possible to take measures against the paper powder generated at both the cutting unit and the slotter•creaser together even in the even of the generation of the paper powder, as the cutting unit is arranged in the proximity of the slotter creaser.

As the counter executer is located away from the cutting unit, the counter executer is secure from the paper powder getting in the stacked corrugated board boxes having been produced and the quality of the corrugated board boxes as a product can be maintained.

In the method of producing the box of the corrugated board sheet, it is preferable that in the step of transferring the plurality of pieces each having the size of one corrugated board box, the plurality of pieces are spaced while being transferred toward the subsequent step by interposing the plurality of pieces having been cut in the cutting step between endless belts that travel in a conveying direction of the corrugated board sheet at a speed faster than a conveyance speed of the corrugated board sheet in the cutting step.

In this manner, with the simple and inexpensive structure of the speed increasing unit having the pair of transferring rolls on an immediate downstream side of the cutting step, the small corrugated board sheets having been cut can be spaced by increasing the transferring speed thereof instead of reducing the transferring speed. In this case, by adjusting the traveling speed of the endless belt, the distance between each corrugated board sheet can be adjusted.

To conduct the above method, the present invention provides a device of producing a box of a corrugated board sheet by preprocessing a corrugated board sheet having a size of a plurality of corrugated board boxes and then cutting the corrugated board box into a plurality of pieces each having a size of one corrugated board box, the device comprising: a creasing unit creasing the corrugated board; a slitting unit slitting the corrugated board; a gluing unit applying glue to the corrugated board; folding unit folding the corrugated board; a cutting unit for cutting the corrugated board sheet into a plurality of pieces each having a size of one corrugated board box along a cutting line intersecting a conveyance direction that is in parallel with a production line of the corrugated board box, the cutting unit being located between a set of the creasing unit and slitting unit and a set of the gluing unit and folding unit; and a speed increasing unit for increasing speed of transferring the plurality of pieces each having the size of one corrugated board box toward a subsequent step so as to space the plurality of pieces by a set distance.

In the above device, the corrugated board sheet having a size of a plurality of small corrugated board boxes is cut symmetrically by the cutting unit, and the small corrugated board sheet having been cut are spaced by the speed increasing unit. On a downstream side of the creasing unit and slotting unit, the corrugated board sheets are transferred individually so that the cutting of the corrugated board sheets can be done one by one with high precision. Finally, the same functions and effects as with the present method can be obtained by the present device.

In the device of the present invention, it is preferable that the speed increasing unit includes: a pair of endless belts which are arranged on an immediate downstream side of the cutting unit so as to interpose a conveyance path of the corrugated board sheet, the pair of endless belts transferring the plurality of pieces having been cut by means of the cutting unit at an increased speed in a conveyance direction of the corrugated board sheet by interposing the plurality of pieces therebetween; and a control unit which adjusts a position at which the pair of endless belts interpose the plurality of pieces therebetween in accordance with an order change of the corrugated board sheet.

With this structure, with the simple and inexpensive structure of the speed increasing unit having the pair of transferring rolls on an immediate downstream side of the cutting unit, the small corrugated board sheets having been cut can be spaced by increasing the transferring speed thereof instead of reducing the transferring speed so as to make it easier to perform the subsequent step. By adjusting the traveling speed of the endless belt, the distance between each corrugated board sheet can be adjusted. In this manner, the corrugated board sheet can be transferred without reducing the transferring speed thereof and the distance between each corrugated board sheet is obtained, thereby improving the product efficiency of the corrugated board box.

It is also possible to adjust the distance between the corrugated board sheets in accordance with the sheet size by adjusting the position at which the corrugated board sheet is interposed by the endless belts.

In the device of producing the box of the corrugated board sheet, it is also preferable that the speed increasing unit includes: a pair of conveying rolls which are arranged on an immediate downstream side of the cutting unit so as to interpose a conveyance path of the corrugated board sheet, the pair of conveying rolls transferring the plurality of pieces having been cut by means of the cutting unit at an increased speed in a conveyance direction of the corrugated board sheet by interposing the plurality of pieces therebetween; a timing detection unit which detects a cutting timing at which the cutting unit cuts the corrugated board sheet; and a control unit which, upon receiving a cutting detection signal from the timing detection unit, increases a conveying speed of the pair of conveying rolls for a set duration between a time point when the cutting of the corrugated board sheet is completed and a time point when the next corrugated board sheet reaches the cutting position.

With this simple and inexpensive structure of the speed increasing unit having the pair of transferring rolls such as a servomotor, the corrugated board sheets having been cut can be spaced at a set distance without reducing the transferring speed.

The device of the present invention preferably further comprises: a space detection unit which is arranged on a downstream side of the speed increasing unit and detects a distance between the plurality of pieces having been cut; and a controller which controls the distance between the plurality of pieces based on a detection value from the space detection unit. With this, by performing the feedback control, the corrugated board sheets having been cut can be spaced precisely at a set distance.

Further, the speed increasing method or the speed increasing unit of the present invention is preferably provided in the subsequent folding unit as well. For instance, while performing the gluing and folding steps in the folding unit, the corrugated board sheets can be spaced.

According to the present invention, the method of producing a box of a corrugated board sheet by preprocessing a corrugated board sheet having a size of a plurality of corrugated board boxes and then cutting the corrugated board box into a plurality of pieces each having a size of one corrugated board box, the method having the steps of: creasing the corrugated board sheet; slitting the corrugated board sheet; gluing the corrugated board sheet; folding the corrugated board sheet; after the creasing and slitting steps and before the gluing and folding steps, cutting the corrugated board sheet into a plurality of pieces each having a size of one corrugated board box along a cutting line intersecting a conveyance direction that is in parallel with a production line of the corrugated board box; and after the step of cutting the corrugated board sheet, transferring the plurality of pieces each having the size of one corrugated board box at an increased speed toward a subsequent step so as to space the plurality of pieces by a set distance. By this, the corrugated board sheet can be cut with high precision and thus even if the cutting precision becomes less accurate, it does not affect the quality of the produced corrugated board box as much as in the conventional case.

Further, the corrugated board sheet can be spaced without reducing the transferring speed of the corrugated board sheet and the production efficiency of the corrugated board box can be kept high and the span of the corrugated board sheet in the transferring direction can be shortened so that the handling of the corrugated board sheet in the gluing and folding steps is made easier and the folding precision is improved.

Furthermore, even in the even of the paper powder being generated in the cutting step, as the cutting step is arranged in the proximity of the slotting step, it is possible to take measures against the paper powder generated during both of the steps together and the stacked corrugated board boxes are secure from the paper powder getting in and the quality of the corrugated board boxes as a product can be maintained.

According to the present device of producing a box of a corrugated board sheet by preprocessing a corrugated board sheet having a size of a plurality of corrugated board boxes and then cutting the corrugated board box into a plurality of pieces each having a size of one corrugated board box, the device comprises: a creasing unit creasing the corrugated board; a slitting unit slitting the corrugated board; a gluing unit applying glue to the corrugated board; folding unit folding the corrugated board; a cutting unit for cutting the corrugated board sheet into a plurality of pieces each having a size of one corrugated board box along a cutting line intersecting a conveyance direction that is in parallel with a production line of the corrugated board box, the cutting unit being located between a set of the creasing unit and slitting unit and a set of the gluing unit and folding unit; and a speed increasing unit for increasing speed of transferring the plurality of pieces each having the size of one corrugated board box toward a subsequent step so as to space the plurality of pieces by a set distance so as to obtain the same functions and effects as the method of the present invention.

DETAILED DESCRIPTION OF THE INVENTION

A preferred embodiment of the present invention will now be described in detail with reference to the accompanying drawings. It is intended, however, that unless particularly specified, dimensions, materials, shape, its relative portions and the like shall be interpreted as illustrative only and not limitative of the scope of the present invention.

First Embodiment

Figure 1:
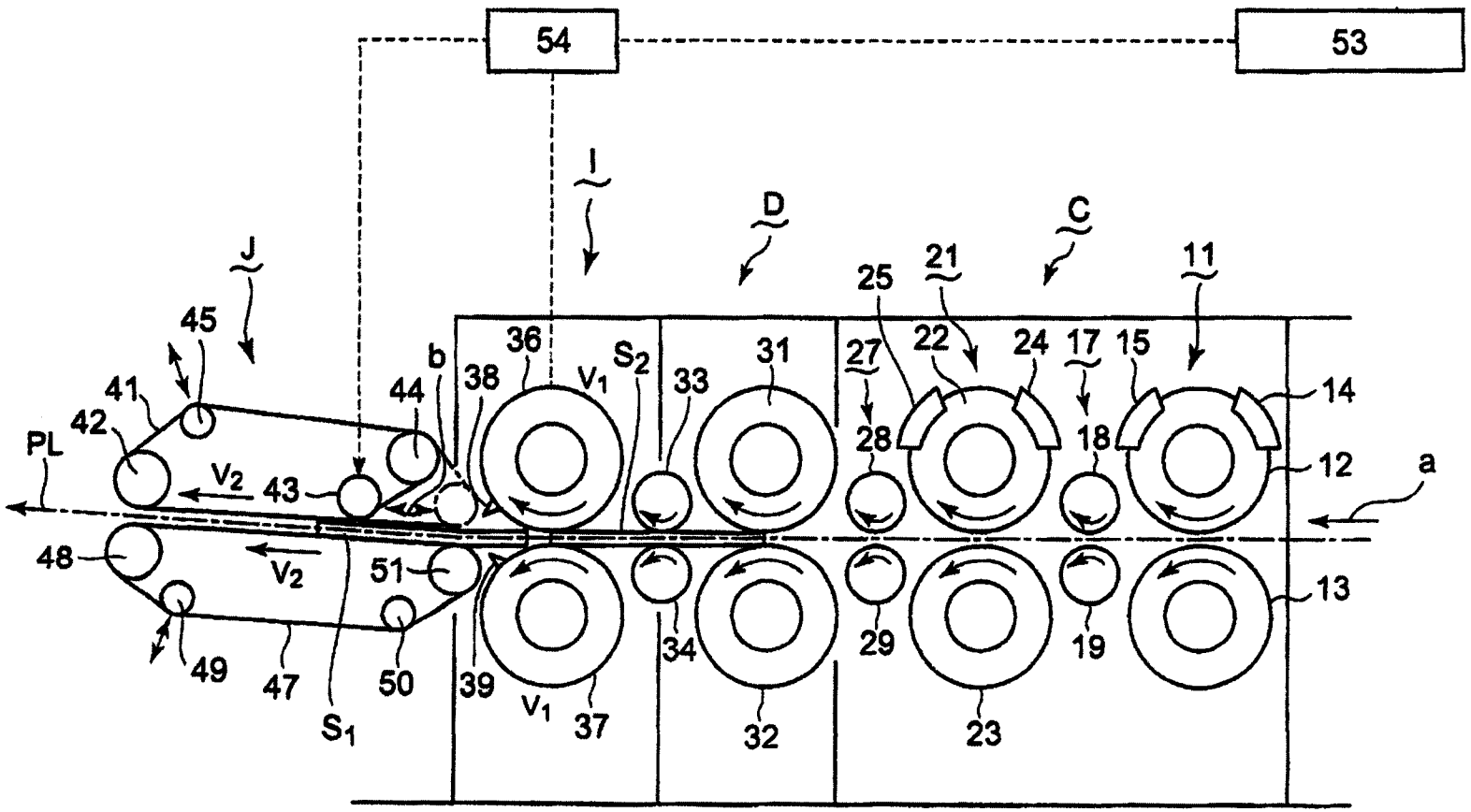
FIG. 1 A partial diagram of a box-producing line of a first embodiment of the present invention.
Figure 2:
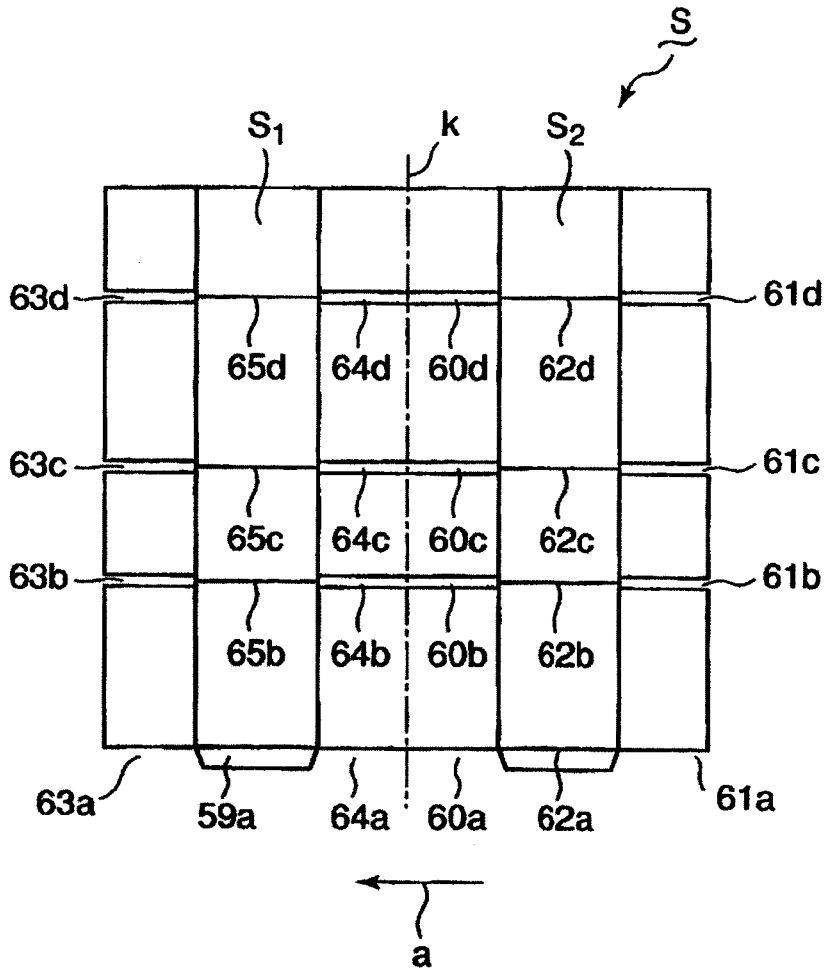
FIG. 2 A plane view of two-box connected corrugated board sheet to be produced into a box in the first embodiment.

A first embodiment of the present invention is explained in reference to FIG. 1 and FIG. 2. FIG. 1 illustrates a part of the box-producing line of the present embodiment. FIG. 2 shows a two-box connected board sheet S (after creasing and slitting steps) having a size of two corrugated board boxes to be produced in the box-producing line. In FIG. 1, the corrugated board sheet S having been printed by the flexo-printing machine not shown in the drawing is transferred to the slotter•creaser unit C. The slotter•creaser unit C has a first slotter unit, a first creaser unit 17, a second slotter unit 21 and a second creaser unit 27 arranged from upstream to downstream in the traveling direction of the corrugated board sheet. The first slotter unit 11 includes an upper slotter 12 and a lower slotter 13 arranged to interpose a conveying line PL of the corrugated board sheet. The upper slotter 12 is equipped with a first slotter knife 14 and a second slotter knife 15 thereon. The first slotter knife 14 is a stationary knife which is fixed to the upper slotter 12 and the second slotter knife 15 is a movable knife which is movable in a circumferential direction of the upper slotter 12. In this manner, the distance between the first slotter knife 14 and the second slotter knife 15 can be adjusted and the slotting positions can be adjusted in accordance with an order change of the corrugated board sheet.

The first creaser unit 17 includes an upper creaser roll 18 and a lower creaser roll 19 arranged to interpose the conveying line PL of the corrugated board sheet. The corrugated board sheet is passed through the rolls so as to make the creasing lines (fold lines) of the two box-connected board sheet S.

Figure 5:
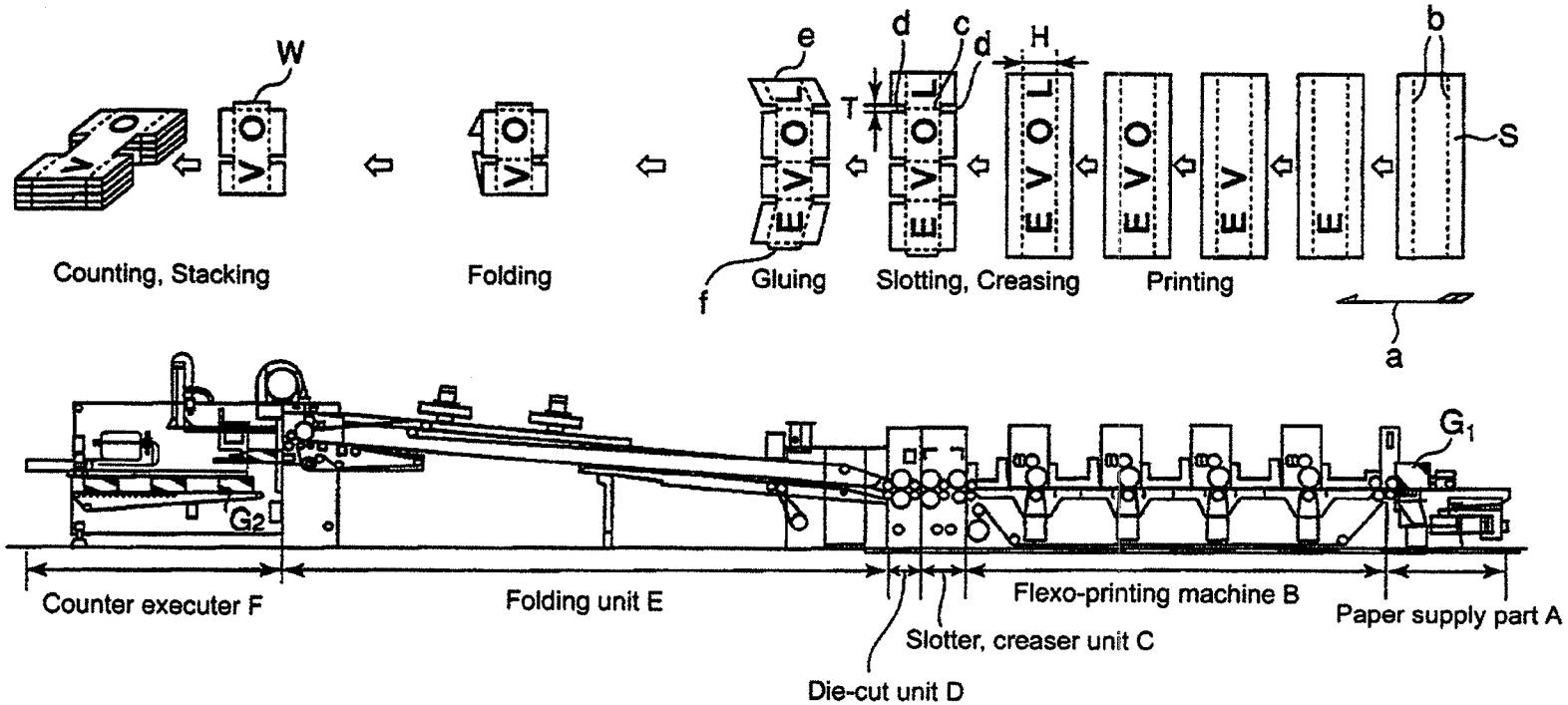
FIG. 5 PRIOR ART
FIG. 5 A general diagram illustrating a box-producing line by a conventional box-producing machine.

The first slotter knife 14 or the second slotter knife 15 has a thickness that corresponds to a width T of the slot d shown in FIG. 5. The lower slotter 13 is equipped with an annular slotter knife (not shown in the drawings) which has a groove with a width corresponding to the width T and a pair of knife edges on a top edge of the groove. The first slotter knife 14 or the second slotter knife 15 is inserted in the groove of the annular slotter knife so as to perform the slotting of the corrugated board sheet.

The second slotter unit 21 has a structure similar to the first slotter unit 11. Specifically, the second slotter unit 21 includes an upper slotter 22 and a lower slotter 23 arranged to interpose a conveying line PL of the corrugated board sheet. The upper slotter 22 is equipped with a first slotter knife 24 which is a stationary knife and a second slotter knife 25 which is a movable slotter knife thereon. The lower slotter 23 is equipped with an annular slotter knife with a groove a pair of knife edges on a top edge of the groove. The creaser unit has an upper creaser roll 28 and a lower creaser roll 29 arranged to interpose the conveying line PL of the corrugated board sheet in a manner similar to the first creaser unit 17.

On a downstream side of the slitter•creaser unit C, a die-cut D is arranged. The die-cut unit D includes an upper die-cut roll 31 and a lower die-cut roll 32 arranged to interpose the conveying line PL of the corrugated board sheet. By the die-cut unit D, a handle hole and other holes are made. On a downstream side of the die-cut unit D, a pair of transferring rolls 33 and 34 arranged to interpose the conveying line PL of the corrugated board sheet, by which the corrugated board sheet is transferred to a cutting unit I located downstream thereof.

The cutting unit I has a pair of upper and lower cutting rolls 36 and 37 arranged to interpose the conveying line of the corrugated board sheet. On an outer circumference of the upper and lower cutting rolls, cutting knives 38 and 39 are implanted in an axial direction thereof.

A speed increasing unit J is provided on a downstream side of the cutting section I. The speed increasing unit J has an upper endless belt 41 and a lower endless belt arranged to interpose the conveying line PL of the corrugated board sheet. The upper endless belt 41 is wound around rolls 42 to 45 and travels in the direction shown with an arrow at a speed $V_2$. The roll 42 is a drive roll that is driven to rotate by a drive unit not shown in the drawings so as to drive the upper endless belt 41. The roll 43 is movable in a parallel direction indicated with an arrow b. The roll 44 is a guide roll that is stationary. The roll 45 is movable in the direction indicated with a two-headed arrow so as to adjust the tension of the upper endless belt 41.

The lower endless belt 47 is wound around rolls 48 to 51 and travels in the same direction and at the same speed ($V_2$) as the upper endless belt 41. The roll 48 is a drive roll that is driven to rotate by a drive unit not shown in the drawings so as to drive the lower endless belt 47. The roll 49 is movable in the direction indicated with a two-headed arrow so as to adjust the tension of the lower endless belt 47. The rolls 50 and 51 are guide rolls that are stationary. The roll 51 is arranged on an immediate downstream side of the upper and lower cutting rolls 36 and 37 and in a location so as to receive the small corrugated board sheet $S_1$ and $S_2$ having been cut and transferred from the upper and lower cutting rolls 36 and 37. A folding unit E is installed consecutively on a downstream side of the speed increasing unit J.

In the present embodiment, the two-box connected corrugated board sheet S (as shown in FIG. 2, the corrugated board sheet S is formed with a size of two boxes. The two-box connected corrugated board sheet S of FIG. 2 has been creased and slotted) is produced. The two-box connected corrugated board sheet S having been printed by the flexo-printing machine is transferred to the slotter•creaser C. In the first slotter unit 11, slots are made in two places on the corrugated board sheet S in the conveying direction by the first and second slotter knives 14 and 15 provided on the upper slotter 12.

In the first slotter unit 11, each of the upper and lower slotter 12 and 13 has four holders in the axial direction of the slotter roll and a slotter knife is installed in each of the holders. With this, slots can be made in four places on the two-box connected corrugated board sheet in a longitudinal direction thereof. The positions of each holder in the axial direction of the slotter roll is set in accordance with an order of the two-box connected corrugated board sheet S by order instructions from a manufacturing control unit 53.

This structure is the same for the first creaser unit 17, the second slotter unit 21 and the second creaser unit 27 of the slotter•creaser unit C and each of them has four holders in the axial direction of the slotter roll, into which a slotter knife or a die for creasing is installed. And in accordance with an order of the two-box connected corrugated board sheet S, the positions of each holder in the axial direction of the slotter roll is set by order instructions from the manufacturing control unit 53.

On the two-box connected corrugated board sheet S of FIG. 2, slots 60*a* to 60*d* and slots 61*a* to 61*d* are made by the first slotter unit 11 and crease lines (fold lines) 62*a* to 62*d* are made by the first creaser unit 17. Next, slots 63*a* to 63*d* and slots 64*a* to 64*d* are made by the second slotter unit 21 and crease lines 65*a* to 65*d* are made by the second creaser unit 27.

The two-box connected corrugated board sheet S is passed through the upper and lower die-cut rolls 31 and 32 so as to make holes such as handle holes. Next, the corrugated board sheet S is transferred to a downstream side by the transferring rolls 33 and 34 and reaches the cutting unit I.

At the cutting unit I, the two-box connected corrugated board sheet S is cut symmetrically along the cutting line k shown in FIG. 2 (the cutting line perpendicular to the conveying direction a) by the cutting knives 38 and 39 provided on the upper and lower cutting rolls 36 and 37 so as to divide the corrugated board sheet S into two small corrugated board sheets $S_1$ and $S_2$ for small boxes. The circumferential speed of the upper and lower cutting rolls 36 and 37 is set to $V_1$ and the conveying speed of the two-box connected corrugated board sheet S before reaching the cutting unit I is set to $V_1$ as well.

The small corrugated board sheets $S_1$ and $S_2$ having been divided by the cutting unit I are next interposed between the pair of endless belts 41 and 47 arranged in the speed increasing unit J so as to be transferred at an increased speed $V_2$ ($V_2>V_1$). The manufacturing control unit 53 controls the operation of the box-producing line and inputs an order of the two-box connected corrugated board sheet S into the control unit 54. In accordance with size instructions of the order sent from the manufacturing control unit 53, the control unit 54 set the position of the movable roll 43 in the direction indicated with the arrow b. With this, the start point of the upper endless belt 41 can be arranged in the optimal location to receive the small corrugated board sheets $S_1$ and $S_2$.

Further, the speeds $V_2$ of the endless belts 41 and 47 are set to be faster than the circumferential speed $V_1$ of upper and lower cutting rolls 36 and 37 of the cutting unit I and the small corrugated board sheets $S_1$ and $S_2$ are transferred to a subsequent unit in a state of being interposed between the endless belts 41 and 47 so as to space the small corrugated board sheets $S_1$ and $S_2$. The distance between the small corrugated board sheets $S_1$ and $S_2$ can be adjusted by changing the speed $V_2$ by the control unit 54. In this manner, it is possible to transfer the small corrugated board sheets $S_1$ and $S_2$ to the folding unit E located consecutively on the downstream side in a state that the small corrugated board sheets $S_1$ and $S_2$ are spaced by a set distance.

According to the present embodiment, after the steps of creasing and slotting and before the steps of gluing and folding, the two-box connected corrugated board sheet S being sent one by one is cut symmetrically by the cutting unit I into the small corrugated board sheets $S_1$ and $S_2$ and thus, the cutting precision is improved.

Furthermore, the two-box connected corrugated board sheet S is cut on the upstream side of the folding unit E so that even if there is a corrugated board sheet having a poor folding precision in the folding unit E, this affects only one small corrugated board sheet.

Moreover, at the speed increasing unit J, the small corrugated board sheet $S_1$ is transferred at an increased speed so as to space the small corrugated board sheets $S_1$ and $S_2$. Thus, overlapping of $S_1$ and $S_2$ in the subsequent folding unit E is prevented and counting of the corrugated board boxes W by the counter executer F is made easier by spacing the small corrugated board sheets $S_1$ and $S_2$.

With the structure, it is not needed to reduce the conveying speed of the small corrugated board sheets $S_1$ and $S_2$. On the contrary, the traveling speed is increased in the present embodiment, thereby improving the production efficiency of the corrugated board box.

The two-box connected corrugated board sheet S is cut into two small corrugated board sheets on the immediate upstream side of the folding unit E so as to shorten the span of the corrugated board sheet in the conveying direction to less than half. Therefore, handling of the small corrugated board sheets $S_1$ and $S_2$ in the folding unit E is made easier, thereby improving the folding precision. As a result, the folding can be performed with excellent precision at a high speed, thereby enhancing the production efficiency, reducing defects and improving the yield of the corrugated cardboard sheet.

Further, as the two-box connected corrugated sheet S is used to produce two small corrugated board boxes, in comparison with the case of using small corrugated board sheets to produce small boxes, the production efficiency is doubled at the same conveying speed.

Furthermore, even in the even of the generation of the paper powder, as the cutting unit I is arranged in the proximity of the slotter•creaser C, it is possible to take measures against the paper powder generated at both the cutting unit I and the slotter•creaser C together and as the counter executer F is located away from the cutting unit I, the counter executer F is secure from the paper powder getting in the stacked corrugated board boxes $G_2$ having been produced and the quality of the corrugated board boxes as a product can be maintained.

In the speed increasing unit I, the small corrugated board sheets $S_1$ and $S_2$ having been cut are interposed between the pair of endless belts 41 and 47 traveling in the conveying direction of the corrugated board sheet and the speed $V_2$ of the endless belts 41 and 47 is set faster than the circumferential speed $V_1$ of upper and lower cutting rolls 36 and 37 of the cutting unit I so that the transferring speed of the small corrugated board sheets $S_1$ and $S_2$ can be increased with a simple structure and the distance between the small corrugated board sheets $S_1$ and $S_2$ can be adjusted by changing the transferring speed $V_2$.

Second Embodiment

Figure 3:
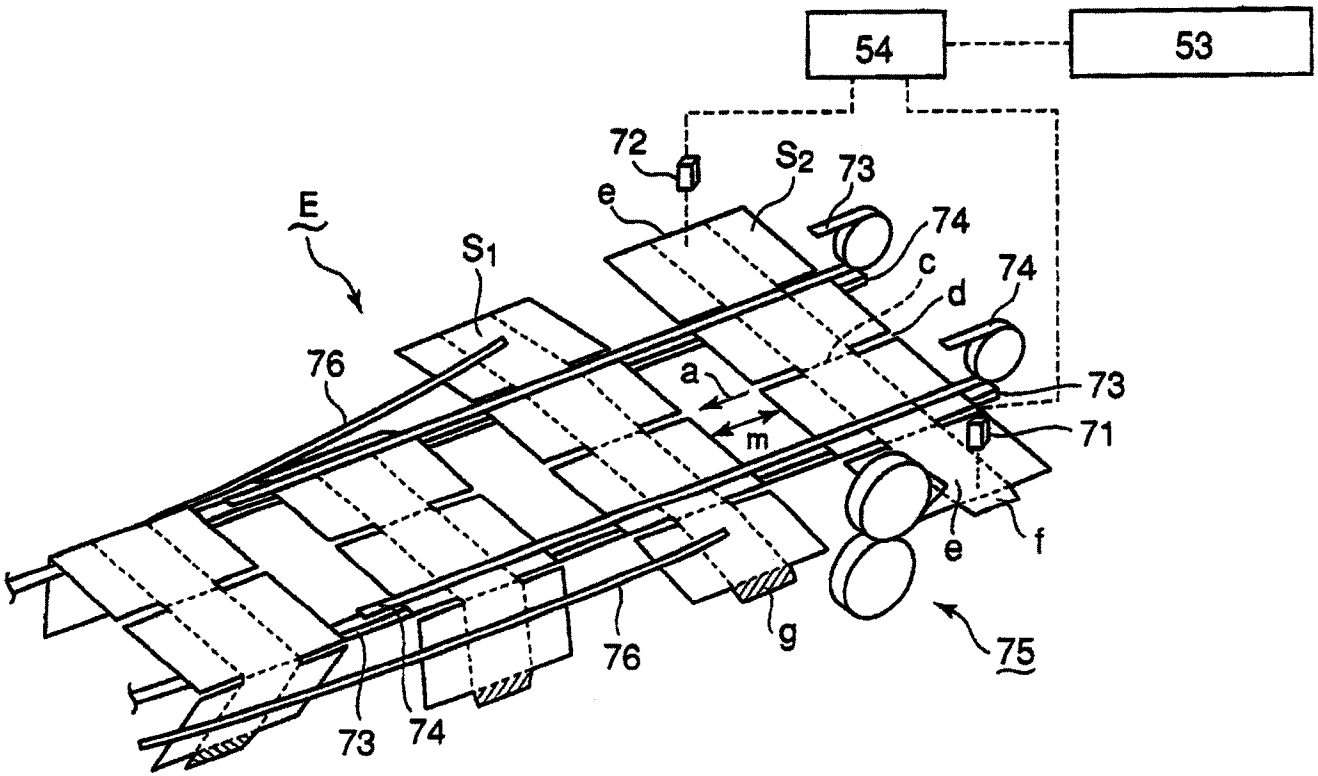
FIG. 3 A perspective view of a part of the box-producing line of a second embodiment.

Next, a second embodiment of the present invention is explained in reference to FIG. 3. FIG. 3 is a perspective view of the folding unit E installed consecutively on the downstream side of the speed increasing unit J of the second embodiment. In the present embodiment, the structure of box-producing line on an upstream side of the speed increasing unit J is the same as the first embodiment. As illustrated in FIG. 3, the small corrugated board sheets $S_1$ and $S_2$ having been cut symmetrically by the cutting section I and spaced by the speed increasing unit J are transferred in the direction indicated with an arrow a in the folding unit E in a state that the small corrugated board sheets $S_1$ and $S_2$ are interposed between a left and right pair of guide rails 73,73 and a left and right pair of transferring belts 74,74.

While being transferred, the glue g is applied to the gluing margin f by the gluing unit 75 and the side panels e are folded by folding bars 76 arranged on left and right sides of the transferring direction. In the present embodiment, contactless detection sensors 71 and 72 are provided on left and right sides in the location at an entrance side of the folding unit E and above the side panel e of the small corrugated board sheets $S_1$ and $S_2$. The contactless detection sensors 71 and 72 may be optical sensors using a phototube for instance.

The contactless detection sensors 71 and 72 detect the distance between the small corrugated board sheets $S_1$ and $S_2$ and inputs the detection results to the control unit 54 which then performs the feedback control so as to space the small corrugated board sheets $S_1$ and $S_2$ by a set distance. By this, the distance m between the small corrugated board sheets $S_1$ and $S_2$ in the downstream side of the speed increasing unit J can be precisely maintained. Therefore, the overlapping of the small corrugated board sheets $S_1$ and $S_2$ can be firmly prevented and the counting of the small corrugated board sheets $S_1$ and $S_2$ by the counter executer F on the downstream side of the folding unit E is made easy.

Further, by providing one contactless detection sensor, the distance between the small corrugated board sheets $S_1$ and $S_2$ can be detected. However, by providing two contactless detection sensors 71 and 72 on both sides of the small corrugated board sheets $S_1$ and $S_2$ to detect both ends of the small corrugated board sheets $S_1$ and $S_2$ at a time, the detection signals from both of the contactless detection sensors 71 and 72 can be measured and compared so that the tilt of the small corrugated board sheets $S_1$ and $S_2$ in the conveying direction a can be detected. Furthermore, by the contactless detection sensors 71 and 72, jam-up or misalignment of the small corrugated board sheets $S_1$ and $S_2$ perpendicular to the transferring direction a can be detected as well.

Third Embodiment

Figure 4:
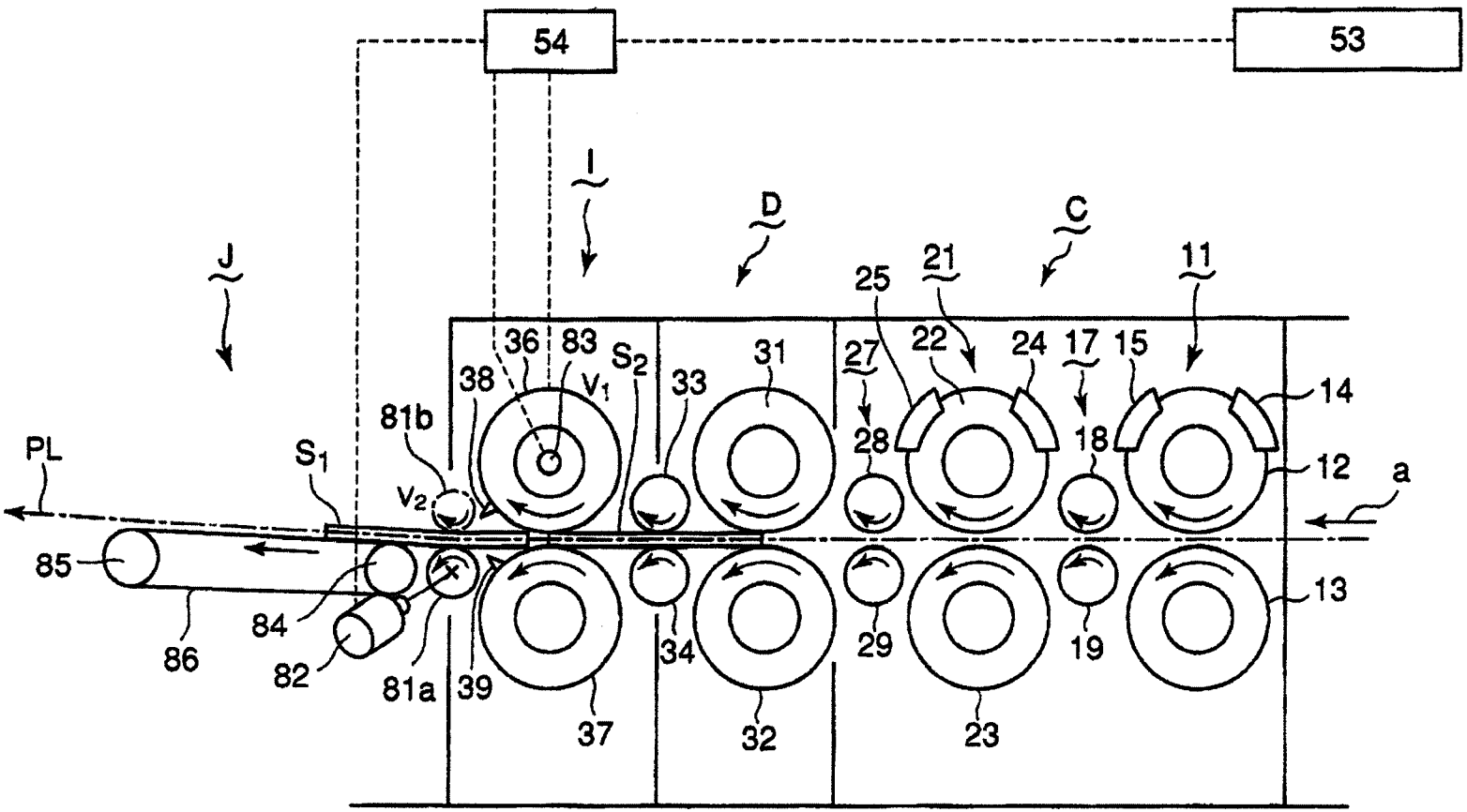
FIG. 4 A partial diagram of a box-producing line of a third embodiment of the present invention.

Next, a third embodiment of the present invention is explained in reference to FIG. 4. FIG. 4 illustrates a box-making line of the present embodiment, which corresponds with FIG. 1. In FIG. 4, a pair of transferring rolls 81*a* and 81*b* are arranged to interpose the conveying line PL of the corrugated board sheet on an immediate downstream side of the upper and lower cutting rolls and transfer the small corrugated board sheets $S_1$ and $S_2$ having been cut in a transferring direction a of the corrugated board sheet. The transferring rolls 81*a* is connected to an output axis of a servomotor 82 and rotated by the servomotor. The transferring roller 81*b* is a driven roller and guides the small corrugated board sheets $S_1$ and $S_2$ passing through the transferring rolls 81*a* and 81*b* in the transferring direction a.

To a rotating axis of the upper cutting roll 36, a detector 83 such as a rotary encoder is connected and detects the cutting timing at which the upper and lower cutting rolls 36 and 37 cut the corrugated board sheet. The detection signal of the detector 83 is sent to the control unit 54. Upon receiving the signal from the detector 83, the control unit 54 controls the servomotor 82 so as to adjust the transferring speed of the transferring roll 81*a* to be the circumferential speed $V_2$ which is faster than the circumferential speed $V_1$ of the upper and lower cutting rolls 36 and 37 for a set duration between a time point when the cutting of the corrugated board sheet by the upper and roller rolls 36 and 37 is completed and a time point when the next small corrugated board sheet reaches the cutting position.

Other than the set duration, the transferring speed of the transferring roll 81*a* is set to be equal to the circumferential speed $V_1$ of the upper and lower cutting rolls 36 and 37. And after increasing the transferring speed to $V_2$, the transferring speed is reduced to $V_1$ to the time point when the next small corrugated board sheet reaches the cutting position.

A roller 84 and a roller 85 are arranged on an immediate downstream side of the pair of transferring rolls 81*a* and 81*b* and down in the conveying line P1, and an endless belt 86 is wound around the rolls 84 and 85. The endless belt 86 forms a conveying surface so as to convey the small corrugated board sheet in the transferring direction a. The endless belt 86 moves at a speed that is same as the circumferential speed $V_1$ of the upper and lower cutting rolls 36 and 37. In this manner, the speed increasing unit J of the present embodiment is constructed. On a downstream side of the endless belt 86, the folding unit E is installed consecutively.

The rest of the structure, i.e. the slotter•creaser C, the die-cut unit D and the cutting unit I is the same as the first embodiment illustrated in FIG. 1 and thus, the same reference numerals are used for those units.

With the structure of the present embodiment, the cutting timing at which the cutting rollers 36 and 37 cut the small corrugated board sheets $S_1$ and $S_2$ is detected by the detector and the servomotor 82 is controlled to adjust the transferring speed of the transferring roll 81*a* to be the circumferential speed $V_2$ which is faster than the circumferential speed $V_1$ of the upper and lower cutting rolls 36 and 37 for a set duration between a time point when the cutting of the corrugated board sheet by the upper and roller rolls 36 and 37 is completed and a time point when the next small corrugated board sheet reaches the cutting position so as to space the small corrugated board sheets $S_1$ and $S_2$ by a set distance.

Figure 6:
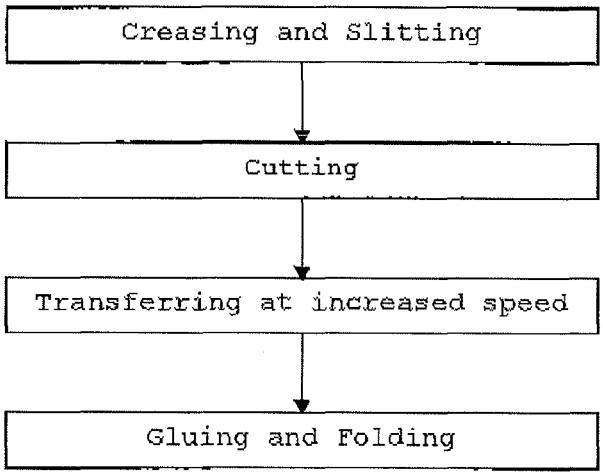
FIG. 6 A flow chart showing a method of producing a plurality of corrugated board boxes according to an embodiment of the present invention.

As illustrated in FIG. 6, a method of producing a plurality of corrugated board boxes includes creasing and slitting a corrugated board sheet. After the creasing and slitting steps, the method further includes cutting the corrugated board sheet into a plurality of pieces; and transferring the plurality of pieces at an increased speed, and then gluing and folding the plurality of pieces.

As described above, with the simple and inexpensive structure of the speed increasing unit J having the pair of transferring rolls 81*a* and 81*b*, the servomotor 82, the detector 83 for detecting the cutting timing by the upper and lower cutting rolls 36 and 37, and the endless belt 86, the small corrugated board sheets $S_1$ and $S_2$ can be spaced without reducing the transferring speed of the small corrugated board sheets $S_1$ and $S_2$. Moreover, the rotation speed of the transferring roll 81*a* can be adjusted by the servomotor 82 so as to arbitrarily adjust the distance between the small corrugated board sheets $S_1$ and $S_2$.

INDUSTRIAL APPLICABILITY

According to the present invention, it is possible to provide the method of producing the box of the corrugated board sheet by which the cutting and the folding precision of the corrugated board sheet is enhanced and the yield of the corrugated board sheet is improved, the production efficiency is enhanced and the paper powder generated during the cutting is solved easily.

The invention claimed is:

1. A method of producing a plurality of corrugated board boxes, the method comprising steps of:

creasing a corrugated board sheet having a size of the plurality of corrugated board boxes;

slitting the corrugated board sheet;

after the creasing and slitting steps, cutting the corrugated board sheet into a plurality of pieces each having a size of one corrugated board box along a cutting line intersecting a conveyance direction that is in parallel with a production line of the corrugated board box;

after the step of cutting the corrugated board sheet and before gluing and folding, transferring the plurality of pieces each having the size of one corrugated board box at an increased speed toward a subsequent step so as to space the plurality of pieces by a set distance:

detecting a distance between the plurality of pieces having been cut, by a space detection unit which is arranged on a downstream side of the speed increasing unit; and controlling the distance between the plurality of pieces based on a detection value from the space detection unit, wherein the space detection unit comprises two sensors provided on both sides of one of the pieces which has just been cut, for detecting the both ends of the one piece at a time.

2. The method according to claim 1, wherein in the step of transferring the plurality of pieces each having the size of one corrugated board box, the plurality of pieces are spaced while being transferred toward the subsequent step by interposing the plurality of pieces having been cut in the cutting step between endless belts that travel in a conveying direction of the corrugated board sheet at a speed faster than a conveyance speed of the corrugated board sheet in the cutting step.

3. A device for producing a plurality of corrugated board boxes, the device comprising:

a creasing unit configured to crease a corrugated board having a size of the plurality of corrugated board boxes;

a slitting unit configured to slit the corrugated board;

a gluing unit configured to apply glue to the corrugated board;

a folding unit configured to fold the corrugated board;

a cutting unit configured to cut the corrugated board sheet into a plurality of pieces each having a size of one corrugated board box along a cutting line intersecting a conveyance direction that is in parallel with a production line of the corrugated board box, the cutting unit being located between a set of the creasing unit and slitting unit and a set of the gluing unit and folding unit;

a speed increasing unit configured to increase a speed of transferring the plurality of pieces each having the size of one corrugated board box toward a subsequent step so as to space the plurality of pieces by a set distance;

a space detection unit which is arranged on a downstream side of the speed increasing unit and is configured to detect a distance between the plurality of pieces having been cut; and a controller which is configured to control the distance between the plurality of pieces based on a detection value from the space detection unit, wherein the space detection unit comprises two sensors provided on both sides of one of the pieces which has just been cut, for detecting the both ends of the one piece at a time.

4. The device according to claim 3, wherein the speed increasing unit includes:

a pair of endless belts which are arranged on an immediate downstream side of the cutting unit so as to interpose a conveyance path of the corrugated board sheet, the pair of endless belts transferring the plurality of pieces having been cut by the cutting unit at an increased speed in a conveyance direction of the corrugated board sheet by interposing the plurality of pieces therebetween; and a control unit which is configured to adjust a position at which the pair of endless belts interpose the plurality of pieces therebetween in accordance with an order change of the corrugated board sheet.

5. The device according to claim 3, wherein the speed increasing unit includes:

a pair of conveying rolls which are arranged on an immediate downstream side of the cutting unit so as to interpose a conveyance path of the corrugated board sheet, the pair of conveying rolls transferring the plurality of pieces having been cut by the cutting unit at an increased speed in a conveyance direction of the corrugated board sheet by interposing the plurality of pieces therebetween; and a timing detection unit which is configured to detect a cutting timing at which the cutting unit cuts the corrugated board sheet, wherein a control unit, upon receiving a cutting detection signal from the timing detection unit, increases a conveying speed of the pair of conveying rolls for a set duration between a time point when the cutting of the corrugated board sheet is completed and a time point when the next corrugated board sheet reaches the cutting position.

6. A device for producing a plurality of corrugated board boxes, the device comprising:

a creasing unit configured to crease a corrugated board having a size of the plurality of corrugated board boxes;

a slitting unit configured to slit the corrugated board;

a gluing unit configured to apply glue to the corrugated board;

a folding unit configured to fold the corrugated board;

a cutting unit configured to cut the corrugated board sheet into a plurality of pieces each having a size of one corrugated board box along a cutting line intersecting a conveyance direction that is in parallel with a production line of the corrugated board box, the cutting unit being located between a set of the creasing unit and slitting unit and a set of the gluing unit and folding unit;

a speed increasing unit configured to increase a speed of transferring the plurality of pieces each having the size of one corrugated board box toward a subsequent step so as to space the plurality of pieces by a set distance;

a space detection unit which is arranged on a downstream side of the speed increasing unit and is configured to detect a distance between the plurality of pieces having been cut; and a controller which is configured to control the distance between the plurality of pieces based on a detection value from the space detection unit.

* * * * *